United States Patent [19]

Beelaard et al.

[11] Patent Number: 4,620,174

[45] Date of Patent: Oct. 28, 1986

[54] DEFLECTION UNIT FOR A COLOR TELEVISION DISPLAY TUBE

[75] Inventors: Wilhelmus A. J. Beelaard; Johannes A. P. de Volder, both of Eindhoven, Netherlands

[73] Assignee: U.S. Philips Corporation, New York, N.Y.

[21] Appl. No.: 718,052

[22] Filed: Mar. 29, 1985

[30] Foreign Application Priority Data

Apr. 6, 1984 [NL] Netherlands ..... 8401102

[51] Int. Cl.[4] ..... H01F 1/00

[52] U.S. Cl. ..... 335/212; 324/426; 324/431

[58] Field of Search ..... 335/210, 212, 213; 313/421, 426, 427, 428, 431

[56] References Cited

U.S. PATENT DOCUMENTS 4,257,023 3/1981 Kamijo ..... 335/210 X
4,386,331 5/1983 Kohzuki ..... 335/213

FOREIGN PATENT DOCUMENTS 57-3353 1/1982 Japan ..... 335/213
2083689 3/1982 United Kingdom ..... 335/210

*Primary Examiner*—George Harris
*Attorney, Agent, or Firm*—Thomas A. Briody; Jack Oisher; William J. Streeter

[57] ABSTRACT

Deflection unit (5) in which field-conducting elements (9,10) are provided between the field deflection coil (8) and the line deflection coil (7) so that a good level of astigmatism as well as an acceptably small coma error and a reduced EW frame distortion are obtained. In order to prevent that the field-conducting elements (9,10) from having a detrimental influence on the ten-pole field generated by the field deflection coil (8), each of the said elements is formed as a slightly curved plate having a central portion (15) on which two limbs (17,19) extending substantially transversely to the axis (Z) of the annular member (6) are formed.

4 Claims, 4 Drawing Figures

DEFLECTION UNIT FOR A COLOR TELEVISION DISPLAY TUBE

Figure 1:
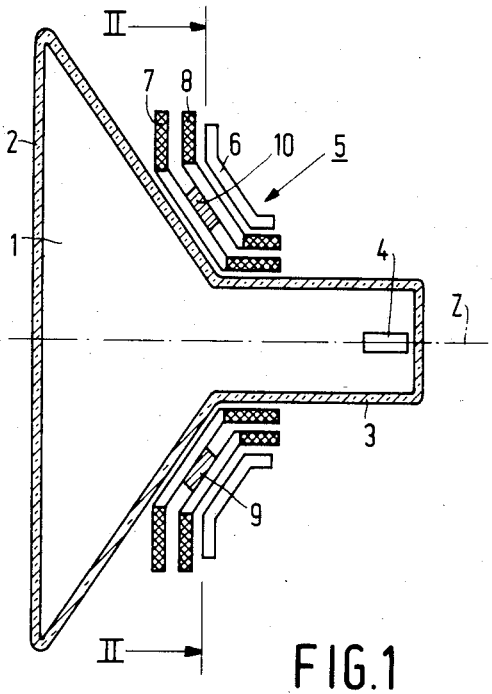

The invention relates to a deflection unit for a colour television display tube, which deflection unit comprises a field deflection coil, a line deflection coil and an annular member of a magnetically permeable material surrounding at least the line deflection coil, the field deflection coil being wound so that, when the deflection unit is mounted on a display tube having a neck portion, a display screen and an intermediately located cup-shaped outer surface it produces, upon energization, a pronounced pincushion-shaped field deflection field on the neck side of the deflection unit andasubstantially homogeneous field deflection field on the screen side of the deflection unit, and being combined with magnetic field-conducting means to generate a pronounced barrel-shaped field distribution in the centre of the field deflection field, said magnetic field-conducting means comprising two soft-magnetic elements provided diametrically opposite to each other between the field and line deflection coils, substantially parallel to the magnetic field of the field deflection coil, near the centre of the field deflection field.

Such a deflection unit is known from Netherlands Patent Application No. 78 01 316 (PHN 9036) laid open to public inspection. This deflection unit is designed to associate a good astigmatism level with an acceptably small coma error with a small EW-frame distortion. This is achieved in that the magnetic field of the field deflection coil extends from the neck side to the screen side in the manner indicated hereinbefore. This magnetic field variation is described in terms of barrel shape and pincushion shape. Another manner of describing deflection fields is known from "Philips Technical Review", 39 (1980) No. 6/7, pp. 154–171. In this article, FIG. 16*a* with associated description shows that a barrel-shaped or pincushion-shaped deflection field can also be described as a combination of a dipole field and a six-pole field. In this manner the effect of the magnetic field-conducting means (making the field locally barrel-shaped) may be described as making the six-pole field generated by the field deflection coil more negative.

Although it has been found that by means of the known field-conduction means the six-pole field generated by the field deflection coil can readily be made more negative, it has been found that the ten-pole field generated by the field deflection coil also becomes more negative.

It is the object of the invention to improve the field-conducting means in such manner that they do not make the ten-pole field generated by the field deflection coil substantially more negative, while their influence on the six-pole field is substantially maintained.

For that purpose, the deflection unit according to the invention is characterized in that each of the two soft-magnetic elements consists of a slightly curved sheet having a central portion, two limbs extending from said central portion, both on its neckside and on its screen-side, substantially transversely to the axis of the annular member.

A preferred embodiment of the deflection unit according to the invention is characterized in that the angle between the limbs on the neck side of the sheet and the axial direction of the annular member is less than 90°.

A further preferred embodiment of the deflection unit according to the invention is characterized in that the angle between the limbs on the screen side of the sheet and the axial direction of the annular member is less than 90°.

Figure 2:
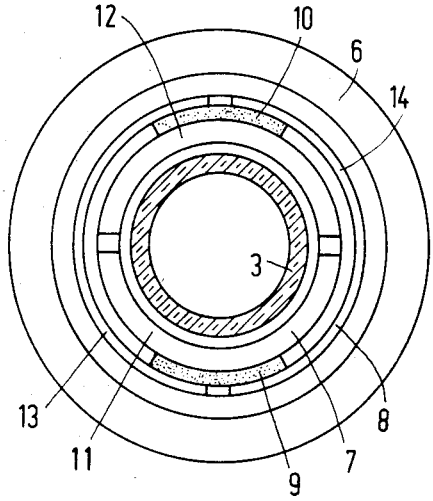
Figure 3:
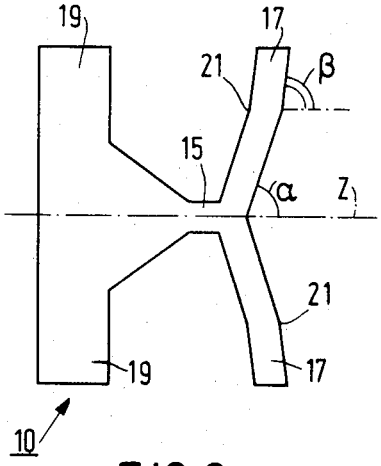
Figure 4:
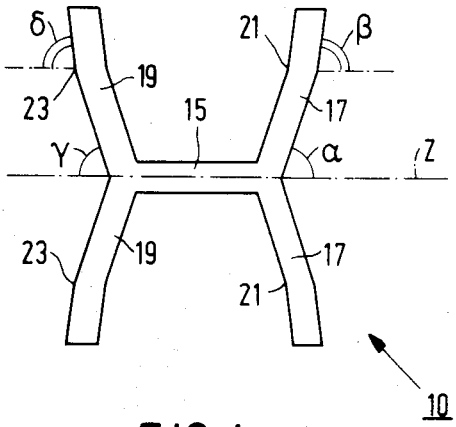

Embodiments of the invention will now be described by way of example with reference to the drawing, in which:

FIG. 1 is a diagrammatic longitudinal sectional view of a colour television display tube having a deflection unit according to the invention, FIG. 2 is a partial elevation and a partial cross-sectional view taken on the line II—II of FIG. 1, FIG. 3 shows a first embodiment of one of the magnetic field-conducting elements used in the deflection unit shown in FIGS. 1 and 2, and FIG. 4 shows a second embodiment of one of the magnetic field-conducting elements used in the deflection unit shown in FIGS. 1 and 2.

FIGS. 1 and 2 show a colour display tube 1 having a display screen 2, a neck 3 and an electron gun configuration 4. An electron beam deflection unit 5 is mounted on the display tube 1. The deflection unit 5 comprises an annular member 6 of a magnetically permeable material which surrounds a line deflection coil 7 and a field deflection coil 8. The deflection coils 7 and 8 in the present case both consist of a set of sub coils 11,12 and 13,14, respectively which are saddle coils of the so-called mussel type, which means that their rear ends (the ends nearest to the neck 3 of the display tube 1) extend parallel to the longitudinal axis Z of the display tube 1 coinciding with the axis of the annular member 6. However, the invention is not restricted to the use of this specific type of saddle-shaped sub coils, or even to any type of saddle-type subcoils. For example, the field deflection coil 8 may alternatively be formed by subcoils wound toroidally on the annular member 6.

The field deflection coil 8 is wound so that upon energization it generates a pronounced pincushion-shaped field on the neck side of the deflection unit 5 and a substantially homogeneous field on the screen side of the deflection unit. For generating a pronounced barrel-shaped field distribution in the centre of the deflection unit 5, elements 9 and 10 of a soft-magnetic material are provided between the deflection coils 7 and 8 in such manner that, viewed in the circumferential direction, the element 9 is located adjacent the window of the line deflection coil part 11 and the element 10 is located adjacent the window of the line deflection coil part 12. As a result of this, the elements 9 and 10 extend substantially parallel to the field of the field deflection coil. For an elaborate description of the fields generated by the deflection coils and of the general operation of the field-conducting means formed by the elements 9 and 10, reference is made to the already mentioned Netherlands Patent Application No. 78 01 316 (PHN 9036) to avoid repetition.

The elements 9 and 10 described here have the same general action as the known field-conductive means, but they have the additional property of not adversely influencing the ten-pole field generated by the field deflection coil. For that purpose they may have the shape which will now be described with reference to FIGS. 3 and 4. These Figures show two embodiments. Although the elements 9 and 10, as is shown in FIG. 2, are slightly curved to follow the curvature of the deflection coils, they are shown in the flat condition in FIGS. 3 and 4 so as to show their structure more clearly. Since the elements 9 and 10 have the same shape only one element is shown in FIGS. 3 and 4, namely element 10. In these Figures this element has the same orientation as in FIG. 1, hence with the screen side directed to the left and the neck side directed to the right. The axis Z of the display tube 1 is also shown in the Figures and, as already noted hereinbefore, coincides with the axis of the annular member 6.

The two embodiments shown for the element 10 consist of a sheet of soft-magnetic material having a central portion 15, on which two limbs 17 extending substantially transversely to the axis Z of the annular member 6 are formed on the neck side (on the right in FIGS. 3 and 4). Furthermore, two limbs 19 extending substantially transversely to the axis Z are also formed on the screen side (on the left in FIGS. 3 and 4).

In the two embodiments the limbs 17 on the neck side are not straight. The portion of the limbs 17 which is connected to the central portion 15 encloses an angle $\alpha$ with the direction of the axis Z which is less than 90° and is also less than the angle $\beta$ between the part of the limbs situated near the free end and said direction. The transition between the two parts of the limbs 17 in the embodiments shown is formed by a bend 21. It is also possible, however, to cause the transition to vary more gradually or even to omit it entirely, so that the limbs 17 are straight. It is to be noted that the angle $\beta$ deviates only little from 90°, while the angle $\alpha$ may be, for example, approximately 60°, so that the general orientation of the limbs 17 may be indicated as substantially transverse to the axis Z.

In the FIG. 3 embodiment the limbs 19 on the screen side are straight throughout their length and at right angles to the axis Z. It has been found that this shape of the elements 9 and 10 satisfies all the requirements described hereinbefore. It has been found that a further improvement of the astigmatism level of the deflection unit 5 can moreover be obtained by giving the limbs 19 on the screen side approximately the same shape as the limbs 17 on the neck side. As a result of this the FIG. 4 embodiment is obtained.

In this embodiment the angle $\gamma$ between the limbs 19 and the direction of the axis Z near their connection with the central portion 15 of the plate is less than 90° and also less than the angle $\delta$ between the arms and the axial direction near the free end of the arms. The angles $\alpha$ and $\gamma$ may be equal to each other just like the angles $\beta$ and $\delta$ but this is not necessary. With the arms 19 also the transition between the two parts may have the shape of a bend 23 or may be more gradual or may be omitted entirely.

It has been found that the value of the angles $\alpha$ and $\gamma$ between the arms 17 and 19, respectively, and the axis Z, as well as the length of said arms especially influence the magnetic field generated by the field deflection coil 8. By choosing these quantities, the designer can hence influence the said field to an important extent. If desired, the length of the limbs 17 and 19 can be made so large that after positioning in the deflection unit 5 the corresponding arms of the elements 9 and 10 contact each other nearly (but not entirely).

What is claimed is:

1. A deflection unit for a colour television display tube, which deflection unit comprises a field deflection coil, a line deflection coil and an annular member of a magnetically permeable material surrounding at least the line deflection coil, the field deflection coil being wound so that, when the deflection unit is mounted on a display tube having a neck portion, a display screen and an intermediately located cup-shaped outer surface, it produces, upon energization, a pronounced pincushion-shaped field deflection field on the neck side of the deflection unit and a substantially homogeneous field deflection field on the screen side of the deflection unit, and being combined with magnetic field-conducting means to generate a pronounced barrel-shaped field distribution in the centre of the field deflection field, said magnetic field-conducting means comprising two soft-magnetic elements provided diametrically opposite to each other between the field and line deflection coils, substantially parallel to the magnetic field of the field deflection coil, near the centre of the field deflection field, characterized in that each of the two soft-magnetic elements consists of a slightly curved sheet having a central portion, two limbs extending from said central portion, both on its neckside and on its screen side, substantially transversely to the axis of the annular member.

2. A deflection unit as claimed in claim 1, characterized in that the angle ($\alpha$) between the limbs on the neck side of the sheet and the axial direction of the annular member is less than 90°.

3. A deflection unit as claimed in claim 2, characterized in that the angle between the limbs on the screen side of the sheet and the axial direction of the annular member is less than 90°.

4. A deflection unit as claimed in claim 2, characterized in that the limbs on the neck side and/or the limbs on the screen side of the sheet are curved, the angle between said limbs and the axial direction of the annular element being smallest near their connection with the central portion of the sheet and being largest near their free ends.

* * * * *